US006514299B1

(12) United States Patent
Bean et al.

(10) Patent No.: US 6,514,299 B1
(45) Date of Patent: Feb. 4, 2003

(54) FUEL ADDITIVE AND METHOD THEREFOR

(75) Inventors: J. David Bean, Albany, KY (US); Willard G. McAndrew, III, Plano, TX (US)

(73) Assignee: Millennium Fuels USA, LLC, Plano, TX (US)

( * ) Notice: Subject to any disclaimer, the term of this patent is extended or adjusted under 35 U.S.C. 154(b) by 261 days.

(21) Appl. No.: 09/710,045

(22) Filed: Nov. 9, 2000

(51) Int. Cl.[7] ..... C10L 1/18
(52) U.S. Cl. ..... 44/444; 44/446
(58) Field of Search ..... 44/340, 444, 338, 44/446

(56) References Cited

U.S. PATENT DOCUMENTS

| | | | | | |
|---|---|---|---|---|---|
| 2,046,243 | A | | 6/1936 | Buc | |
| 2,114,676 | A | | 4/1938 | Contardi et al. | |
| 2,152,196 | A | | 3/1939 | Kokatnur | |
| 2,194,496 | A | | 3/1940 | Christensen | |
| 2,563,101 | A | | 8/1951 | Colwell et al. | |
| 2,807,525 | A | | 9/1957 | Foreman | |
| 2,807,526 | A | | 9/1957 | Foreman | |
| 2,827,494 | A | | 3/1958 | Brown et al. | |
| 2,878,109 | A | | 3/1959 | Wood et al. | |
| 3,455,664 | A | | 7/1969 | Rosscup et al. | |
| 3,869,262 | A | | 3/1975 | Mayerhoffer et al. | |
| 4,125,382 | A | * | 11/1978 | O'Brien et al. | 44/387 |
| 4,261,702 | A | * | 4/1981 | Sweeney et al. | 44/402 |
| 4,276,055 | A | * | 6/1981 | Huang | 44/438 |
| 4,302,214 | A | * | 11/1981 | Sweeney | 44/444 |
| 4,390,344 | A | | 6/1983 | Sweeney | |
| 4,395,267 | A | | 7/1983 | Sweeney | |
| 4,397,655 | A | * | 8/1983 | Sweeney | 44/308 |
| 4,410,334 | A | | 10/1983 | Parkinson | |
| 4,610,696 | A | | 9/1986 | Bernasconi et al. | |
| 4,647,288 | A | * | 3/1987 | Dillon | 44/329 |
| 4,732,575 | A | | 3/1988 | Forschirm | |
| 4,906,274 | A | | 3/1990 | Mattox | |
| 5,332,407 | A | * | 7/1994 | Herbstman | 210/696 |
| 5,354,344 | A | * | 10/1994 | Takizawa et al. | 44/350 |
| 5,489,719 | A | * | 2/1996 | Le et al. | 568/688 |
| 5,609,654 | A | * | 3/1997 | Le et al. | 44/449 |
| 5,746,785 | A | * | 5/1998 | Moulton et al. | 44/443 |
| 5,858,030 | A | | 1/1999 | Waller et al. | |
| 6,039,772 | A | * | 3/2000 | Orr | 44/359 |
| 6,251,146 | B1 | * | 6/2001 | Jackson | 44/393 |

FOREIGN PATENT DOCUMENTS

| | | |
|---|---|---|
| GB | 802181 | 10/1958 |

* cited by examiner

*Primary Examiner*—Margaret Medley
(74) *Attorney, Agent, or Firm*—Luedeka, Neely & Graham PC

(57) ABSTRACT

The invention provides a fuel additive composition including from about 85 to about 99% by volume $C_1$–$C_4$ alcohol having a first blending octane number and from about 1.0 to about 15% by volume ether compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range. The resulting composition has a third blending octane number which is substantially greater than a linear addition of the first and second blending octane numbers of the components of the mixture. In the composition, the second blending octane number is substantially lower than the first blending octane number. The fuel additive composition significantly increases the octane number of a gasoline fuel without detrimentally affecting the environment.

22 Claims, No Drawings

FUEL ADDITIVE AND METHOD THEREFOR

FIELD OF THE INVENTION

The invention relates to fuel additives and to processes for making the fuel additives which additives provide octane enhancing performance without significant environmental consequences.

BACKGROUND OF THE INVENTION

Fuels, particularly gasoline grade fuels have undergone many changes over the years in order to improve engine performance and reduce engine emissions. Many octane improving compounds used for improving engine performance and extending fuel supplies, such as tetraethyl lead, aromatic compounds, methylcyclopentadienyl manganese tricarbonyl, methyl tertiary butyl ether (MTBE) and other such additives, have fallen into disfavor because of concerns about adverse environmental consequences arising from their use. Accordingly, there is a need for improved fuel additives which provide enhanced engine performance and can be used to extend fuel supplies without adversely affecting the environment.

SUMMARY OF THE INVENTION

With regard to the foregoing, the invention provides a fuel additive composition including from about 85 to about 99% by volume $C_1$–$C_4$ alcohol having a first blending octane number and from about 1.0 to about 15% by volume of a compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range. The resulting composition has a third blending octane number which is substantially greater than a linear addition of the first and second blending octane numbers of the components of the mixture. In the composition, the second blending octane number is substantially lower than the first blending octane number.

In another aspect the invention provides a method for making a fuel additive composition. The method includes heating a $C_1$–$C_4$ alcohol in the presence of a neutral or basic platinum catalyst to a temperature and pressure sufficient to produce an additive composition containing from about 85 to about 99% by volume $C_1$–$C_4$ alcohol having a first blending octane number and from about 1.0 to about 15% by volume of a compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range, wherein the alcohol is heated in the substantial absence of aldehydes or ketones. In the composition, the second blending octane number is substantially lower than the first blending octane number.

In yet another aspect the invention provides a method for increasing the octane number of a gasoline fuel. According to the method, from about 85 to about 95% by volume gasoline fuel having a base octane number is mixed with from about 5 to about 15% by volume fuel additive composition including a $C_1$–$C_4$ alcohol containing a minor amount of an ether compound selected from the group consisting of dialkoxyalkanes, alkoxyalcohols, trialkoxyalkanes, dialkoxycycloalkanes and aryl alkyl diethers having a boiling point in the gasoline boiling range, wherein the amount of ether compound in the alcohol additive composition is sufficient to increase a blending octane number of the gasoline fuel an amount ranging from about 4 to about 15% over the base octane number of the gasoline fuel.

The fuel additive composition as described above provides what is believed to be a synergistic increase in octane number of the additive composition and fuel over what would be expected based on the octane number of the components. For the purposes of this invention, the octane number is defined as (R+M)/2 wherein R is the research octane number and M is the motor octane number. The synergistic increase in octane number was totally unexpected.

DETAILED DESCRIPTION OF THE PREFERRED EMBODIMENTS

An important aspect of the invention is the use of a relatively low molecular weight ether compound in combination with a $C_1$–$C_4$ alcohol to provide a fuel additive having octane improving characteristics for use in gasoline fuels. The relatively low molecular weight compound is selected from the group consisting of dialkoxyalkanes, alkoxyalcohols, trialkoxyalkanes, dialkoxycycloalkanes and aryl alkyl diethers having a second blending octane number and a boiling point in the gasoline boiling range.

Preferred dialkoxyalkanes having the desired characteristics include, but are not limited to, 1,1-diethoxyethane, 1,2-dimethoxyethane, 1,2-dimethoxypropane, and 1,2-diethoxyethane and the like. The alkoxyalcohols may be selected from 2-ethoxyethanol and 2-(2-methoxyethoxy) ethanol and the like. Trialkoxyalkanes which may be used include 1,1,1-trimethoxypentane, 2-ethoxyethyl ether and 2-methoxyethyl ether and the like. A preferred dialkoxycycloalkane includes 1,1-dimethoxycyclohexane and the like. The aryl alkyl ethers may be selected from 1,2-dimethoxybenzene, 1,4-dimethoxybenzene, 2,3-dimethoxytoluene, 3,5-dimethoxytoluene and the like.

A particularly preferred ether compound is a di- or tri-alkoxy alkane, most preferably a compound of the formula $$R^1{-}CH(OR^2)_x$$

wherein $R^1$ is selected from the group consisting of a hydrogen atom and an alkyl group containing from about 1 or 4 carbon atoms, $R^2$ is selected from the group consisting of methyl and ethyl groups and x is an integer selected from 2 and 3. Of the ether compounds 1,1-diethoxyethane (acetal) and 1,1,1-trimethoxypentane are the most preferred. Ether compounds of the foregoing formula are conventionally formed by reacting aldehydes or ketones with an excess of alcohol in the presence of trace mineral acid. The formation of acetal under these conditions is an equilibrium process. That is, acetal in the presence of water and acid react to form alcohol and aldehyde.

In contrast to conventional processes for forming acetals, a unique process is provided which not only produces acetals, but provides an additive composition having desirable octane enhancing qualities. According to the process, a relatively pure $C_1$–$C_4$ alcohol, most preferably ethanol, is heated in a reaction vessel in the presence of a catalyst at a temperature and pressure sufficient to form a mixture containing from about 1.0 to about 15% by volume acetal and from about 85 to about 99% by volume $C_1$–$C_4$ alcohol. Trace amounts of water may be present in the alcohol. The term "relatively pure" means that the alcohol used as a reactant is from about 95% by volume to about 100% by volume alcohol.

The catalyst is selected from noble metal catalysts such as palladium, gold, silver, ruthenium, rhodium, iridium and platinum and is preferably platinum. The platinum catalyst may be supported or unsupported. If supported, it is preferred that the catalyst support be a neutral or basic catalyst support such as neutral or basic aluminum oxide. The amount of catalyst present on a supported catalyst may range from about 0. 15 to about 0.45% by weight catalyst per weight of support material.

The reaction is preferably conducted at a temperature ranging from about 120° to about 210° C. and at a pressure ranging from about 350 to about 650 psia. The reaction is conducted for a period of time sufficient to increase the amount of ether compound in the alcohol to the desired amount. A preferred amount of ether compound in the alcohol product ranges from about 1.0 to about 15% by volume based on the total volume of reaction product. A particular preferred reaction product contains from about 2 to about 10% by volume acetal or 1,1,1-trimethoxypentane and from about 90 to about 98% by volume alcohol.

The reaction may be conducted continuously or in a batch or semi-batch process. Since the reaction time at elevated temperatures is relatively fast, relatively small reaction vessels are needed to provide the additive compositions as claimed. Depending on the scale of the reaction, reaction times may vary from 30 minutes to 3 hours or more using volumetric space velocities ranging from about 3.0 to about 15.0 feed vol./catalyst vol.

EXAMPLE 1

In the following example, ethanol was reacted with a 0.3 wt. % platinum catalyst on a mixed aluminum oxide support. The reaction was conducted in a tubular reactor heated with an oil bath. The reaction pressure ranged from about 395 to about 405 psig. The reactions were conducted from 2.5 to 3.0 hours and product was removed from the reactors and analyzed. Denatured ethanol was fed to the reactor in each of the runs.

TABLE 1

| Run # | Time (min.) | Press. (psig) | Oil Bath Temp. (° C.) | Feed Flow rate (cc/min.) | Reactor Volume (cc) | Space velocity (Feed vol./cat. vol.) | Calculated Octane No. (feed) | Calculated Octane No. of Product |
|---|---|---|---|---|---|---|---|---|
| 1 | 0 | 400 | 275 | 2.38 | 16.1 | 8.8 | 156.2 | 156.2 |
| 1 | 56 | 405 | 276 | 2.47 | 16.1 | 9.2 | 156.2 | 161.1 |
| 1 | 103 | 400 | 274 | 2.14 | 16.1 | 8.0 | 156.2 | 162.1 |

Prior to reaction, the ethanol had a calculated octane number in the 80 octane reference fuel of 156.2. During the reaction, the calculated octane number of the product substantially increased.

The compositions made by the foregoing process may be added to base unleaded fuels to increase the octane number of the fuels. Compositions of the invention may also be made by blending an ether compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range and an alcohol in the desired volumetric proportions. Accordingly, ether compound and alcohol may be blended to provide synergistically increased octane blending values over the octane blending values expected. For example, the following formulations were made and actual octane blending values were compared to expected octane blending values as seen in the following table. As in table 1, the octane numbers of the components or blends were determined by using an 80 octane reference fuel. The octane numbers were calculated from the actual octane numbers of the fuel and component or blend according to the following equation:

$$\text{octane no.}=(\text{octane no. of fuel and component or blend}-\text{fuel octane no.}*0.9)/0.1$$

TABLE 2

| Sample # | Vol. % acetal | Acetal Octane No. | Vol. % Alcohol | Alcohol Octane No. | Expected Octane No. of blend | Actual Octane No. of Blend | % Increase over expected |
|---|---|---|---|---|---|---|---|
| 1 | 10 | 56.2 | 90 | 156.2 | 146.2 | 153.1 | 4.7 |
| 2 | 2 | 56.2 | 98 | 156.2 | 154.2 | 158.2 | 2.6 |
| 3 | 100 | 56.2 | — | — | 56.2 | 56.2 | 0 |

The octane number of neat ethanol or a blend of ethanol and an ether according to the invention could not be determined without first blending the ethanol or blend of ethanol and ether compound with a reference fuel. In the following table, the product was blended with an 80 octane reference fuel in a blend of 90% by volume reference fuel and 10% by volume product. The octane numbers were calculated numbers based on the increase in octane number of the reference fuel and were calculated according to the following equation:

$$\text{octane no.}=(\text{octane no. of fuel and component}-\text{fuel octane no.}*0.9)/0.1$$

The following table contains operating conditions for the reactions.

As seen in the foregoing table, the additive compositions of the invention have a substantially higher octane number than expected ranging from about 2 to about 5% higher than the values calculated by adding the individual values based on the amount of each of the components in the additive.

Furthermore, the compositions of Samples 1 and 2 when added to gasoline fuels substantially increased the octane number of the fuels over the base values. The following table provides examples of octane improvements expected by use of compositions according to the invention. The additive samples used to make the fuel and blend were listed in Table 2

TABLE 3

| Sample # | Vol. % Fuel | Fuel base Octane No. | Additive Sample No. | Actual Octane No. of Fuel | % Increase over Base Fuel Octane No. |
|---|---|---|---|---|---|
| 1 | 90 | 80.2 | 3 | 77.8 | 0 |
| 2 | 90 | 80.1 | 1 | 87.4 | 9.1 |
| 3 | 90 | 80.2 | 2 | 88.0 | 10.0 |

As seen in Table 3, the fuel additives provided a substantial increase in the octane numbers over the octane number of the base fuel.

Similar results were obtained for fuels containing blends of ethanol (EtOH) having a calculated octane numer of 114 and 1,1,-trimethoxypentane (TMP) as shown in the following table. In Table 4, sample 1 contained no additive. Sample 2 contained 10 volume % ethanol and samples 3 and 4 contained an additive blend of ethanol and 1,1,1-trimethoxypentane. In each of samples 2, 3 and 4, the amount of additive in the fuel was 10% by volume.

TABLE 4

| Sample # | Vol. % Fuel | Base Fuel Octane No. | Vol. % TMP in EtOH | Octane No. of Blend | Octane No. of Fuel | Calculated Octane No. of TMP | % Increase over Base Fuel Octane No. |
|---|---|---|---|---|---|---|---|
| 1 | 100 | 87 | 0 | 0 | 87 | N/A | 0 |
| 2 | 90 | 87 | 0 | 0 | 89.7 | N/A | 3.1 |
| 3 | 90 | 87 | 5 | 127 | 91.0 | 374 | 4.6 |
| 4 | 90 | 87 | 20 | 101 | 88.4 | 49 | 1.6 |

Base fuel containing a 10% by volume ethanol or a blend of ethanol and 1,1,1-trimethoxypentane exhibited an increase in octane number over the base fuel as seen in Table 4. The largest increase in octane number was obtained when the blend contained less than 20% by volume 1,1,1-trimethoxypentane.

As seen in the foregoing tables, alcohol blends containing more than about 10% by volume ether compound appear to cause a lower increase in octane number of the blend than lower amounts of the ether additive. Above about 20% by volume, the octane number of the blend of 1,1,1-trimethoxyethane in ethanol was below that of the neat ethanol.

It is contemplated, and will be apparent to those skilled in the art from the foregoing specification, and examples, that modifications and/or changes may be made in the embodiments of the invention. Accordingly it is expressly intended that the foregoing are only illustrative of the preferred embodiments and modes of operation, not limiting thereto, and that the true spirit and scope of the present invention be determined by reference to the appended claims.

What is claimed is:

1. A fuel additive composition consisting essentially of from about 85 to about 99% by volume $C_1$–$C_4$ alcohol having a first blending octane number and from about 1.0 to about 15% by volume ether compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range, the composition having a third blending octane number substantially greater than a linear addition of the first and second blending octane numbers of the components of the mixture, wherein the second blending octane number is substantially lower than the first blending octane number.

2. The fuel additive composition of claim 1 wherein the ether compound comprises 1,1-diethoxyethane.

3. The fuel additive composition of claim 1 wherein the ether compound comprises 1,1,1-trimethoxypentane.

4. The fuel additive composition of claim 1 wherein the alcohol comprises ethanol.

5. The fuel additive composition of claim 1 wherein the ether compound comprises a compound of the formula $$R^1—CH(OR^2)_x$$

wherein $R^1$ is selected from the group consisting of a hydrogen atom and an alkyl group containing from 1 to 4 carbon atoms, $R^2$ is selected from the group consisting of methyl and ethyl groups and x is an integer selected from 2 and 3.

6. The fuel additive composition of claim 1 wherein the third blending octane number is from about 2 to about 8% greater than the linear addition of the first and second blending octane numbers of the components of the mixture.

7. A gasoline fuel containing from about 5 to about 15% by volume of the fuel additive composition of claim 1.

8. A method for making a fuel additive composition comprising heating a $C_1$–$C_4$ alcohol in the presence of a neutral or basic platinum catalyst to a temperature and pressure sufficient to produce an additive composition containing from about 85 to about 99% by volume $C_1$–$C_4$ alcohol having a first blending octane number and from about 1.0 to about 15% by volume ether compound selected from the group consisting of dialkoxyalkanes, alkoxyalcohols, trialkoxyalkanes, dialkoxycycloalkanes and aryl alkyl diethers having a second blending octane number and a boiling point in the gasoline boiling range, wherein the alcohol is heated in the substantial absence of aldehydes or ketones and wherein the second blending octane number is substantially lower than the first blending octane number.

9. The method of claim 8 wherein the ether compound comprises 1,1-diethoxyethane.

10. The method of claim 8 wherein the ether compound comprises 1,1,-trimethoxypentane.

11. The method of claim 8 wherein the alcohol comprises ethanol.

12. The method of claim 8 wherein the ether compound comprises a compound of the formula $$R^1—CH(OR^2)_x$$

wherein $R^1$ is selected from the group consisting of a hydrogen atom and an alkyl group containing from 1 to 4 carbon atoms, $R^2$ is selected from the group consisting of methyl and ethyl groups and x is an integer selected from 2 and 3.

13. The method of claim 8 wherein the third blending octane number is from about 2 to about 8% greater than the linear addition of the first and second blending octane numbers of the components of the mixture.

14. The method of claim 8 wherein the reaction temperature ranges from about from about 125° to about 200° C.

15. The method of claim 8 wherein the reaction pressure ranges from about 350 to about 650 psia.

16. A gasoline fuel containing from about 5 to about 15% by volume of the fuel additive composition made by the method of claim 8.

17. A method for increasing the octane number of a gasoline fuel comprising mixing from about 85 to about 95% by volume gasoline fuel having a base octane number with from about 5 to about 15% by volume fuel additive composition consisting essentially of a $C_1$–$C_4$ alcohol containing from about 1.0 to about 15% by volume of an ether compound selected from the group consisting of dialkoxyalkanes, alkoxyalcohols, trialkoxyalkanes, dialkoxycycloalkanes and aryl alkyl diethers having a boiling point in the gasoline boiling range wherein the amount of ether compound in the alcohol additive composition is sufficient to increase a blending octane number of the gasoline fuel an amount ranging from about 5 to about 15% over the base octane number of the gasoline fuel.

18. The method of claim 17 wherein the ether compound comprises 1,1-diethoxyethane.

19. The method of claim 17 wherein the ether compound comprises 1,1,1-trimethoxypentane.

20. The method of claim 17 wherein the alcohol comprises ethanol.

21. The method of claim 17 wherein the ether compound comprises a compound of the formula $$R^1—CH(OR^2)_x$$

wherein $R^1$ is selected from the group consisting of a hydrogen atom and an alkyl group containing from 1 to 4 carbon atoms, $R^2$ is selected from the group consisting of methyl and ethyl groups and x is an integer selected from 2 and 3.

22. A gasoline fuel composition made by the method of claim 17.

* * * * *